US009970669B2

(12) United States Patent
Chang et al.

(10) Patent No.: US 9,970,669 B2
(45) Date of Patent: May 15, 2018

(54) INTEGRATED HEAT PUMP AND THERMOELECTRIC COOLING WITH A BLADELESS FAN

(71) Applicant: Google LLC, Mountain View, CA (US)

(72) Inventors: Lawrence Chang, Palo Alto, CA (US); Shelomon Patrick Doblack, Santa Clara, CA (US)

(73) Assignee: Google LLC, Mountain View, CA (US)

( * ) Notice: Subject to any disclaimer, the term of this patent is extended or adjusted under 35 U.S.C. 154(b) by 16 days.

(21) Appl. No.: 15/280,205

(22) Filed: Sep. 29, 2016

(65) Prior Publication Data

US 2017/0097168 A1 Apr. 6, 2017

Related U.S. Application Data

(60) Provisional application No. 62/236,258, filed on Oct. 2, 2015.

(51) Int. Cl.

| | |
|---|---|
| ***F24F 5/00*** | (2006.01) |
| ***F24F 1/02*** | (2011.01) |
| ***F24F 11/00*** | (2018.01) |
| ***F24F 13/22*** | (2006.01) |
| ***E06B 7/03*** | (2006.01) |

(Continued)

(52) U.S. Cl.

CPC ..... *F24F 5/0042* (2013.01); *E06B 7/02* (2013.01); *E06B 7/03* (2013.01); *E06B 7/10* (2013.01); *E06B 7/28* (2013.01); *F24F 1/02* (2013.01); *F24F 1/027* (2013.01); *F24F 5/0075* (2013.01); *F24F 11/0012* (2013.01); *F24F 11/0034* (2013.01); *F24F 13/20* (2013.01);

(Continued)

(58) Field of Classification Search

CPC ..... F24F 5/0042; F24F 5/0075; F24F 1/02; F24F 11/0034; F24F 13/20; F24F 1/027; F24F 13/224; F24F 2221/20; F24F 2011/0013; E06B 7/10; E06B 7/28; E06B 7/02; E06B 7/03

See application file for complete search history.

(56) References Cited

U.S. PATENT DOCUMENTS

| | | | | |
|---|---|---|---|---|
| 2,322,904 A | | 6/1943 | Williams | |
| 3,040,538 A | * | 6/1962 | Alsing | F24F 1/02 136/204 |

(Continued)

FOREIGN PATENT DOCUMENTS

| | | |
|---|---|---|
| CN | 203131993 U | 8/2013 |

OTHER PUBLICATIONS

International Search Report and Written Opinion of PCT/US2016/054633 dated Feb. 16, 2017, all pages.

*Primary Examiner* — Emmanuel Duke

(74) *Attorney, Agent, or Firm* — Kilpatrick Townsend & Stockton LLP

(57) ABSTRACT

Various air conditioner systems and methods are presented. An air ventilation chamber assembly may include a first chamber and a second chamber through which air is circulated into an environment to be cooled. A cooling element of a heat pump, may pass through the first chamber of the air ventilation chamber assembly, wherein the cooling element does not pass through the second chamber of the air ventilation chamber assembly. A Peltier cooler may be present that has a cold side and a hot side. The cold side may be is thermodynamically coupled with a surface of the second chamber.

19 Claims, 12 Drawing Sheets

(51) Int. Cl.

| | |
|---|---|
| ***E06B 7/02*** | (2006.01) |
| ***E06B 7/28*** | (2006.01) |
| ***F24F 13/20*** | (2006.01) |
| ***E06B 7/10*** | (2006.01) |

(52) U.S. Cl.
CPC ..... *F24F 13/224* (2013.01); *F24F 2011/0013* (2013.01); *F24F 2221/20* (2013.01)

(56) References Cited

U.S. PATENT DOCUMENTS 3,085,405 A * 4/1963 Frantti ..... A62B 17/005 607/104
3,186,477 A 6/1965 Bell
3,212,275 A * 10/1965 Tillman, Jr. ..... F25B 21/02 136/204
3,259,053 A 7/1966 Steel
3,416,329 A 12/1968 Marshall
4,129,996 A 12/1978 Hardin et al.
5,761,908 A * 6/1998 Oas ..... F24F 12/006 165/11.1
5,901,572 A * 5/1999 Peiffer ..... B60H 1/00 165/104.12
7,310,953 B2 * 12/2007 Pham ..... F25B 25/00 62/3.2
7,926,294 B2 * 4/2011 Tsai ..... F25B 25/00 62/3.2
2001/0005990 A1 * 7/2001 Kim ..... F24F 5/0042 62/3.1
2006/0075756 A1 * 4/2006 Chen ..... F24F 5/0042 62/3.2
2007/0012049 A1 * 1/2007 Chen ..... F24F 5/0042 62/3.2
2008/0105213 A1 * 5/2008 Chen ..... A01K 1/033 119/500
2008/0209913 A1 * 9/2008 Sung ..... B60H 1/2221 62/3.61
2012/0117983 A1 * 5/2012 Akiyama ..... B60H 1/00478 62/3.4
2014/0165606 A1 * 6/2014 Oh ..... F25B 21/02 62/3.3

* cited by examiner

INTEGRATED HEAT PUMP AND THERMOELECTRIC COOLING WITH A BLADELESS FAN

CROSS-REFERENCE TO RELATED APPLICATION

This application claims the benefit of U.S. Application Ser. No. 62/236,258 filed Oct. 2, 2015, the entire disclosure of which is hereby incorporated by reference for all purposes. This application is related to U.S. patent application Ser. No. 15/280,163, entitled "See-Through In-Window Air Conditioner Unit," which is hereby incorporated by reference for all purposes.

BACKGROUND

Conventional in-window air conditioners tend to be loud (often in the 50-60 dB range), large, and heavy. Installation of such an air conditioner within a window can be difficult due to its weight and bulk. Once installed, the air conditioner blocks visibility through the portion of the window occupied by the air conditioner. When occupied by an air conditioner, the window may also otherwise be non-functional; that is, while the air conditioner is installed, it may not be possible to safely open the window for fresh air. Further, air conditioners are typically made a standard size and have expandable spacers on one or both sides to allow the air conditioner to laterally fill a space created by opening the window to accommodate the air conditioner. Such spacers are typically poor insulators, allowing heat to enter the room being cooled by the air conditioner. Further, conventional in-window air conditioners tend to rely exclusively on a refrigeration cycle using a refrigerant, compressor, and expansion valve. Such an arrangement may not be efficient in certain temperature environments.

SUMMARY

Various air conditioning systems are presented. An air conditioning system may include: an air ventilation chamber assembly. The assembly may include a first chamber and a second chamber through which air is circulated into an environment to be cooled. The assembly may include a cooling element, such as evaporator tubing, passing through the first chamber of the air ventilation chamber assembly, wherein the cooling element does not pass through the second chamber of the air ventilation chamber assembly. The assembly may include a Peltier cooler having a cold side and a hot side, wherein the cold side is thermodynamically coupled with a surface of the second chamber.

Embodiments of such an air conditioning system may include one or more of the following features: An air conditioning system may include a bladed air driver that induces and/or entrains airflow through the first chamber of the air ventilation chamber assembly by moving air through the second chamber of the air ventilation chamber assembly. An air conditioning system may include a Peltier cooler assembly. The Peltier cooler assembly may include: the Peltier cooler, a second Peltier cooler, and a heat pipe. The second Peltier cooler may have a second cold side and a second hot side. The second cold side may be thermodynamically coupled with a surface of the first chamber. The hot side of the Peltier cooler and the second hot side of the second Peltier cooler may be thermodynamically coupled with the heat pipe. An air conditioning system may include a plurality of fins arranged in the first chamber of the air ventilation chamber assembly such that each of the plurality of fins is perpendicular to the cooling element. An air conditioning system may include: a condensation collection assembly located along an inner surface of the first chamber of the air ventilation chamber assembly. An air conditioning system may include a second air ventilation chamber assembly. The second assembly may include: a third chamber and a fourth chamber through which air is circulated into the environment to be cooled, wherein the cooling element passes through the third chamber of the second air ventilation chamber assembly but not the fourth chamber of the air ventilation chamber assembly. The second assembly may include a second Peltier cooler having a second cold side and a second hot side, wherein the cold side is thermodynamically coupled with a surface of the fourth chamber. An air conditioning system may include a through-unit window, the through-unit window permitting an unobstructed view through the air conditioner system between the first air ventilation chamber assembly and the second air ventilation chamber assembly. The through-unit window may be removable to permit air to pass from an exterior environment into an interior environment between the air ventilation chamber assembly and the second air ventilation chamber assembly. An air conditioning system may include a bladed air driver that induces and/or entrains airflow from the exterior environment to the interior environment between the air ventilation chamber assembly and the second air ventilation chamber assembly by moving air through the second chamber and the fourth chamber. A portion of cooling element may be thermodynamically coupled with a surface of the second air chamber of the air ventilation chamber assembly such that a second portion of the cooling element is located outside of the second air chamber. An air conditioning system may include an evaporator and compressor that circulate refrigerant through tubing that is part of the cooling element. Operation of the air conditioner system may be operable to provide heating to the environment by reversing a voltage applied to the Peltier cooler and operating a heat pump, which comprises the evaporator tubing, in reverse. An air conditioning system may include a thermostat control system that controls the Peltier cooler independently of a compressor that pumps refrigerant through the evaporator tubing.

In some embodiments, an air conditioner apparatus is presented. The apparatus may include a ventilation chamber means. The ventilation chamber means may include a first chamber and a second chamber through which air is circulated into an environment to be cooled. The apparatus may include a heat pump means (e.g., heat pump and components, vapor compression system) having an element (e.g., tubing, thermodynamically conductive tubing, etc.) passing through the first chamber of the ventilation chamber means, wherein the element does not pass through the second chamber of the ventilation chamber means. The apparatus may include a thermoelectric cooling means (e.g., one or more Peltier coolers) having a cold side and a hot side, wherein the cold side is thermodynamically coupled with the second chamber. The apparatus may include an electronic control means (e.g., smart thermostat, thermostat, processing system, controller, etc.) that independently controls the thermoelectric cooling means and the heat pump means.

Embodiments of such an air conditioner apparatus may include one or more of the following features: The apparatus may include an air driving means (e.g., bladeless fan, bladed fan, other air moving device) that causes airflow through the first chamber of the ventilation chamber means and through the second chamber of the ventilation chamber means. The apparatus may include a plurality of heat sink means arranged in the first chamber of the ventilation chamber means. The apparatus may include a plurality of heat sink means (e.g., fins, conductive protrusions, etc.) arranged in the first chamber of the ventilation chamber means. The apparatus may include a condensation collection means (e.g., pan, depression, tray, etc.) located along an inner surface of the first chamber of the ventilation chamber means.

The apparatus may include a through-unit viewing means (e.g., window made of glass, plastic, or some other transparent or translucent material) the through-unit viewing means permitting an unobstructed view through the air conditioner apparatus between the ventilation chamber means and a second ventilation chamber means. The apparatus may include a wireless communication means (e.g., a wireless communication interface component that uses WiFi® or some other communication protocol) that receives temperature measurements from a remote temperature sensor unit.

In some embodiments, a method for cooling an indoor environment using an in-window air condition unit is presented. The method may include receiving a setpoint temperature. The method may include measuring a first indoor temperature. The method may include comparing the first indoor temperature with the setpoint temperature. The method may include, based on comparing the first indoor temperature with the setpoint temperature activating a vapor compression mode. The vapor compression mode may include circulating air through a ventilation chamber while a heat pump is active, wherein the ventilation chamber comprises a first chamber and a second chamber through which air is circulated into the indoor environment being cooled. The method may include, after activating the vapor compression mode, measuring a second indoor temperature. The method may include comparing the second indoor temperature with the setpoint temperature. The method may include, based on comparing the second indoor temperature and the setpoint temperature, activating a thermoelectric cooler mode. The method may include circulating air through the ventilation chamber while one or more thermoelectric coolers are active and the heat pump is disabled.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1:
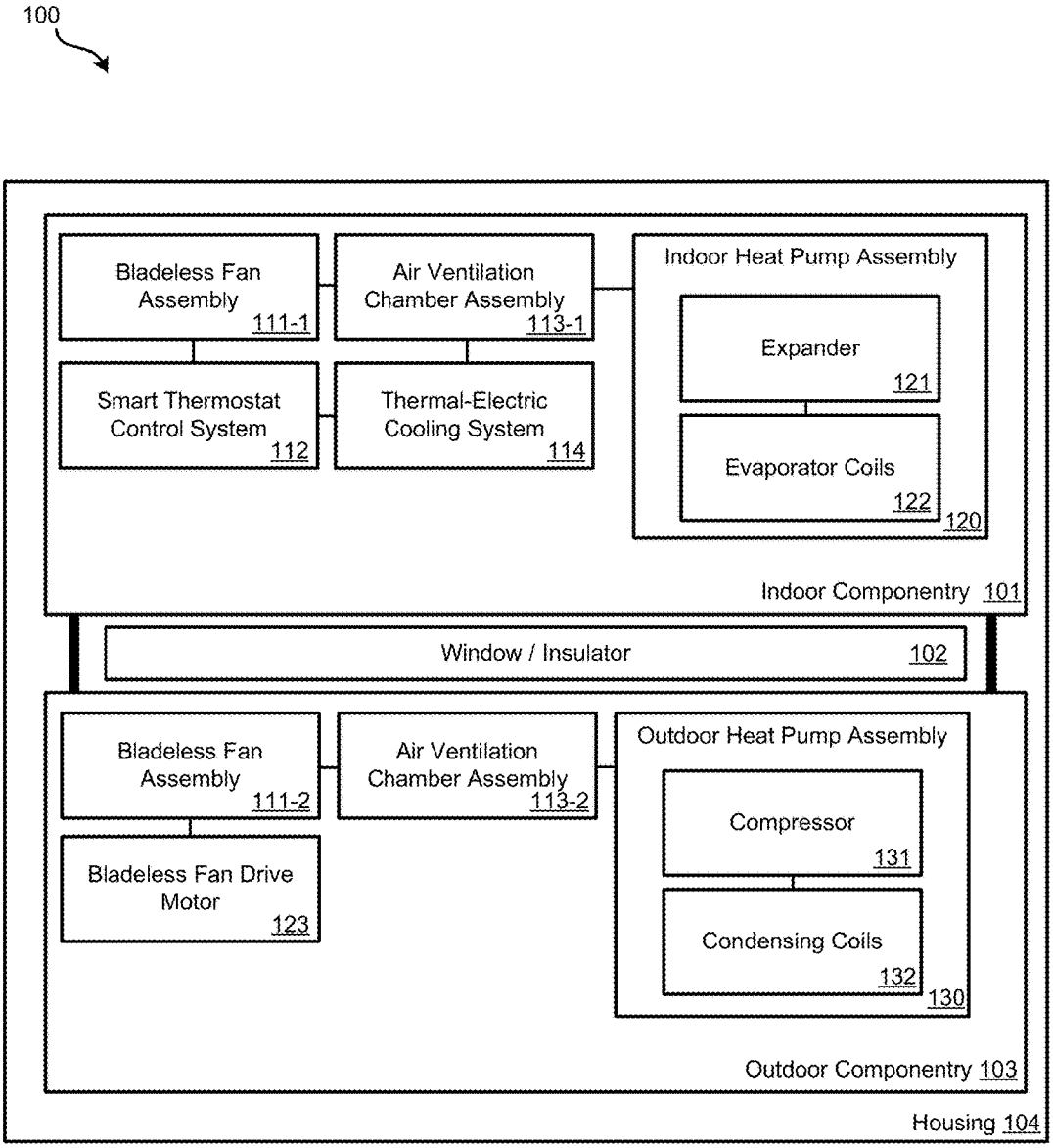
FIG. 1 illustrates a block diagram of an embodiment of an air conditioner unit.

Embodiments detailed herein allow for various improvements to conventional, in-window air conditioner units. Various embodiments detailed herein allow for components of an in-window air conditioner unit ("ACU") to be temporarily installed in a window of a structure or permanently incorporated as part of the window. ACUs detailed herein can allow for componentry of the ACU to be arranged around a central window, thus allowing a user a view of the outdoors through the central window and, possibly, for air to be vented between the outdoors and indoors through the central window, when opened. Additionally or alternatively, embodiments detailed herein may use one or more Peltier coolers and/or bladeless fans, which can reduce the size, weight, and noise of the ACU and/or increase efficiency (reduce power consumption) compared to a conventional air conditioning unit. Further, such ACUs may function as heat pumps—allowing the ACU to be used for both heating and cooling of an interior space of a structure, such as a home or office.

In some embodiments, a single electric motor is presented in the ACU and may be located on the outside portion of the ACU. This motor may drive both bladeless fans using a drive chain, drive belt, gearing system, or some other mechanical energy transfer arrangement. The bladeless fan may allow the ACU to be smaller in height and depth. This arrangement may provide greater concentrated air flow and performance.

A transparent window may be present in a center region of the ACU allowing a direct view of the outdoors from an indoor side of the ACU. The window may be a multi-pane (e.g., dual pane) glass that helps provide thermal separation between the hot and cold sides of the ACU. In addition to insulation, the glass can provide an aesthetic quality by allowing more visibility to outside and light to enter inside the home. Additionally, the window may provide a better sound barrier to any noisy components of the ACU located on an outdoor portion of the ACU, such as a compressor and an electric motor.

Evaporator loops of embodiments detailed herein may be shaped in elongated loops to fit against the air vents of the ACU and at least partially encircle at least a portion of the transparent window. Additionally or alternatively, a smart (e.g., learning) thermostat may be incorporated with or in communication with the ACU to intelligently control the temperature of the room and efficiently operate components of the ACU.

Thermal-electric coolers (also referred to as Peltier coolers), which are based on the principle of Peltier cooling, can have a wide range of operating efficiencies depending on the difference in temperature between the hot and cold sides of the cooler device.

Embodiments can exhibit high energy efficiency at a relatively low operating current and a small temperature differential between a hot and cold side of the thermal-electric cooler. A vapor compression system can be used to cool a room to a target temperature, and then blend in the thermal electric cooler when the temperature differential is smaller. It may then be possible to turn off the vapor compression system to operate the ACU efficiently. Further, a variable speed compressor may be used to drive the vapor compression system, thus allowing use of a smooth transfer of operating from a vapor compression mode to a thermal-electric cooling mode.

FIG. 1 illustrates a block diagram of an embodiment of an air conditioner unit 100. Air conditioner unit 100 may be installed in and removable from a window by a user. Air conditioner unit 100 may be installed in a horizontal position for a vertically actuated window, such as illustrated in FIG. 3, or may be installed in a vertical position for a horizontally actuated window. In some embodiments, ACU 100 may be permanently incorporated as part of a window that can be installed. ACU 100 can have three distinct regions: indoor componentry 101, window/insulator 102 (also simply referred to as window 102), and outdoor componentry 103. ACU 100 may be divided at least roughly in half by window 102. Window 102 may be positioned such that, when ACU 100 is installed in a structure's window, window 102 is at least approximately aligned with the structure's window. Window 102 may effectively divide indoor componentry 101 from outdoor componentry 103, with indoor componentry 101 residing within housing 104 such that indoor componentry 101 is on an indoor side of window 102 when ACU 100 is installed in a structure's window and outdoor componentry 103 is on an outdoor side of window 102 when ACU 100 is installed in a structure's window.

Window 102 may be made from a transparent material, such as glass or plastic. In some embodiments, window 102 is multi-pane glass, such as dual-pane glass. Window 102 may provide multiple functions including: allowing visibility through a portion of ACU 100, providing insulation (both between indoor componentry 101 and outdoor componentry 103 and, when installed, between the inside of a structure and the outside of the structure), and/or providing noise isolation such that noise generated by outdoor componentry 103 is less audible inside of the structure in which ACU 100 is installed. Window 102 may only be present in roughly a portion of ACU 100 that permits viewing through the ACU 100 from the indoor side of ACU 100 to the outdoor side of the ACU and/or the reverse. In some embodiments, window 102 may extend further within housing 104 to provide additional sound isolation and/or insulation; such a portion of window 102 may not be visible to a user from either the indoor or outdoor side of ACU 100. Within housing 104, one or more gaps or regions in window 102 may exist to allow mechanical, thermal, and electrical connections between indoor componentry 101 and outdoor componentry 103.

ACU 100 may use multiple bladeless fans to circulate air through both indoor componentry 101 and outdoor componentry 103. A bladeless fan, which can also be referred to as an air multiplier, does use blades which are concealed in a base or assembly (there are no exposed blades). These blades are powered by an electric motor (which, in the embodiment of FIG. 1, is represented by bladeless fan drive motor 123). A bladeless fan uses the fluid dynamic properties of inducement and entrainment to effectively multiply the amount of air being driven by the hidden blades in the bladeless fan assembly. Air that is driven by the blades in the bladeless fan assembly is output through a series of slits, holes, or other passageways. Air from behind such slits, holes, or other passageways is drawn forward through the fluid dynamic property of inducement. Further, air surrounding the edges of the series of slits, holes, or other passageways also flows in the direction of air pushed by the blades of the bladeless fan assembly through the series of slits, holes, or other passageways through the fluid dynamic property of entrainment. As such, the amount of air moved by the bladeless fan can be multiple times (e.g., 10-20 times) the air directly driven by the blades of bladeless fan assembly.

In ACU 100, a single bladeless fan drive motor 123 drives blades present in bladeless fan assemblies 111 (111-1, 111-2). Bladeless fan drive motor 123 may be a brushless-electric motor. A drive belt, chain, or other drive system may transfer rotational energy from bladeless fan drive motor 123 to blade assemblies of bladeless fan assembly 111-2 and bladeless fan assembly 111-1. In the case of bladeless fan assembly 111-1, window 102 allows for a gap within housing 104 to allow the drive belt, chain, or other drive system to extend from outdoor componentry 103 to bladeless fan assembly 111-1 of indoor componentry 101. The drive system may be permanently engaged between bladeless fan drive motor 123 for both bladeless fan assemblies 111 or may be engaged selectively such that each bladeless fan assembly may be engaged separately from the other. By having bladeless fan drive motor 123 located as part of outdoor componentry 103, noise and/or heat generated by the bladeless fan drive motor 123 may be lessened indoors, at least partly due to the position of bladeless fan drive motor 123 and window 102. In some embodiments, each bladeless fan assembly of bladeless fan assemblies 111 may have separate local drive motors or both drive motors may be located as part of outdoor componentry 103.

Each of bladeless fan assemblies 111 may include an intake vent, a contained blade assembly, and an output to an associated air ventilation chamber assembly. Bladeless fan assembly 111-1 may be isolated from bladeless fan assembly 111-2. That is, bladeless fan assembly 111-1 can have an air intake and output that is located on an inside of housing 104 while bladeless fan assembly 111-2 has a separate air intake and output that is located on an outside of housing 104 such that air is not exchanged between bladeless fan assembly 111-1 and bladeless fan assembly 111-2.

Smart thermostat control system 112 of indoor componentry 101 may allow a user to define one or more setpoint temperatures such that the air temperature within one or more rooms of the structure in which ACU 100 is installed is maintained. Smart thermostat control system 112 may incorporate various "smart" features, such as those exhibited by the Nest® Thermostat. For example, smart thermostat control system 112 may include a multi-functional display unit, one or more wireless communication interfaces, one or more temperature sensors, an occupancy sensor, and one or more processors. The smart thermostat control system 112, via a wireless communication interface, may communicate with other temperature control devices, such as temperature sensors and/or thermostats installed within the structure. For example, a user may define a setpoint at a central thermostat which wirelessly controls ACU 100 or provides the defined setpoint to smart thermostat control system 112. Smart thermostat control system 112 may control ACU 100 according to a defined or learned schedule and may adjust the schedule based on user input. Additionally or alternatively to communicating with other temperature control devices within the structure, smart thermostat control system 112 may be able to communicate with a remote server system. This remote server system may provide temperature setpoints, schedule data, software updates, and user input (e.g., a user may provide input via an application executed by a mobile device which is routed to ACU 100 via the Internet and the remote server system). An occupancy sensor may be used to adjust operation of ACU 100. For instance, a setpoint temperature may be raised when ACU 100 is operating in a cooling mode to save energy when no occupant is detected in a vicinity of ACU 100 or a setpoint temperature may be lowered when ACU 100 is operating in a heating mode to save energy when no occupant is detected in a vicinity of ACU 100.

Smart thermostat control system 112 may be able to wirelessly communicate with other smart thermostat control systems of other ACUs or dedicated thermostats installed within the structure. Such communication may be used to coordinate in which operating mode each ACU functions (e.g., by using two or more ACUs in a lower power mode using only Peltier coolers) and/or coordinate the timing of cooling and/or heating cycles, such as to limit peak power consumption and/or allow for a more constant temperature throughout the structure. When communicating with a dedicated thermostat, coordination with centralized heating and/or cooling devices may be performed, such as to limit peak power consumption and/or allow for a more constant temperature throughout the structure.

Indoor componentry 101 may include air ventilation chamber assembly 113-1. Air ventilation chamber assembly 113-1 may include two air ventilation chambers. Air may be directly driven through a first chamber by bladeless fan assembly 111-1 and air may be induced and/or entrained to flow through the second air ventilation chamber. Further detail regarding bladeless fan assembly 111-1 is provided in relation to FIGS. 5 and 6. Air ventilation chamber assembly 113-2 may also be present and may be part of outdoor componentry 103. Air ventilation chamber assembly 113-2 may also include air ventilation chambers. Air may be directly driven through a first chamber by bladeless fan assembly 111-2 and air may be induced and/or entrained to flow through the second air ventilation chamber of air ventilation chamber assembly 113-2. As with bladeless fan assemblies 111, air ventilation chamber assembly 113-1 may be isolated from air ventilation chamber assembly 113-2. That is, air circulated indoors through air ventilation chamber assembly 113-1 and bladeless fan assembly 111-1 may be isolated from air circulated outdoors through air ventilation chamber assembly 113-2 and bladeless fan assembly 111-2.

Thermoelectric cooling system 114 may include one or more Peltier coolers. The one or more Peltier coolers may cool air that passes through one or more of the ventilation chambers of air ventilation chamber assembly 113-1 using the Peltier effect. One or more heat pipes may be present to remove heat from a hot side of each Peltier cooler. The cool side of each Peltier cooler may be exposed to air in one or more ventilation chambers of air ventilation chamber assembly 113-1. In some embodiments, a thermoelectric cooling system is only present as part of indoor componentry 101. In some embodiments, thermoelectric cooling systems are present as part of both indoor componentry 101 and outdoor componentry 103.

ACU 100 may include a heat pump. A heat pump may be able to move heat in two directions. In the case of ACU 100, heat may be moved from an indoor side of ACU 100 to the outdoor side, by operating in a cooling mode. Alternatively, heat may be moved from an outdoor side of ACU 100 to the indoor side by operating in a heating mode. In some embodiments, rather than having a heat pump, ACU 100 may only be able to operate in the cooling mode. The heat pump system of ACU 100 may be understood as separated into two sections: indoor heat pump assembly 120 and outdoor heat pump assembly 130. Indoor heat pump assembly 120 may include expander 121 and a cooling element, such as evaporator loops 122. Expander 121 may be in the form of an expansion valve that allows a refrigerant to be compressed on one side of expander 121 and expand on the opposite side within evaporator loops 122 and condensing loops 132. Evaporator loops 122 allow refrigerant to expand as part of a vapor-compression refrigeration cycle. It should be understood that evaporator loops 122 may function as condensing loops when the heat pump is serving to pump heat to the indoor side of ACU 100; the embodiment of FIG. 1 assumes ACU 100 is operating in a cooling mode to cool air on the indoor side of ACU 100. While expander 121 is illustrated as part of indoor heat pump assembly 120, it should be understood that expander 121 may be situated between indoor componentry 101 and outdoor componentry 103 or as part of outdoor heat pump assembly 130. For example, condensing loops 132 may transition into being evaporator loops 122 at expander 121 which may be roughly in-plane with window 102.

Compressor 131 may reside as part of outdoor heat pump assembly 130. By having compressor 131 located as part of outdoor componentry 103, noise and heat generated by compressor 131 may be isolated from an indoor portion of ACU 100 and the indoors generally. Condensing loops 132 may house compressed refrigerant that was compressed by compressor 131. When operating in a cooling mode, condensing loops 132 may serve to transfer heat from evaporator loops 122 to the outdoors. However, it should be understood that condensing loops 132 may function as evaporator loops when ACU 100 is operating in a heating mode to transfer heat from outdoors to indoors.

Figure 2:
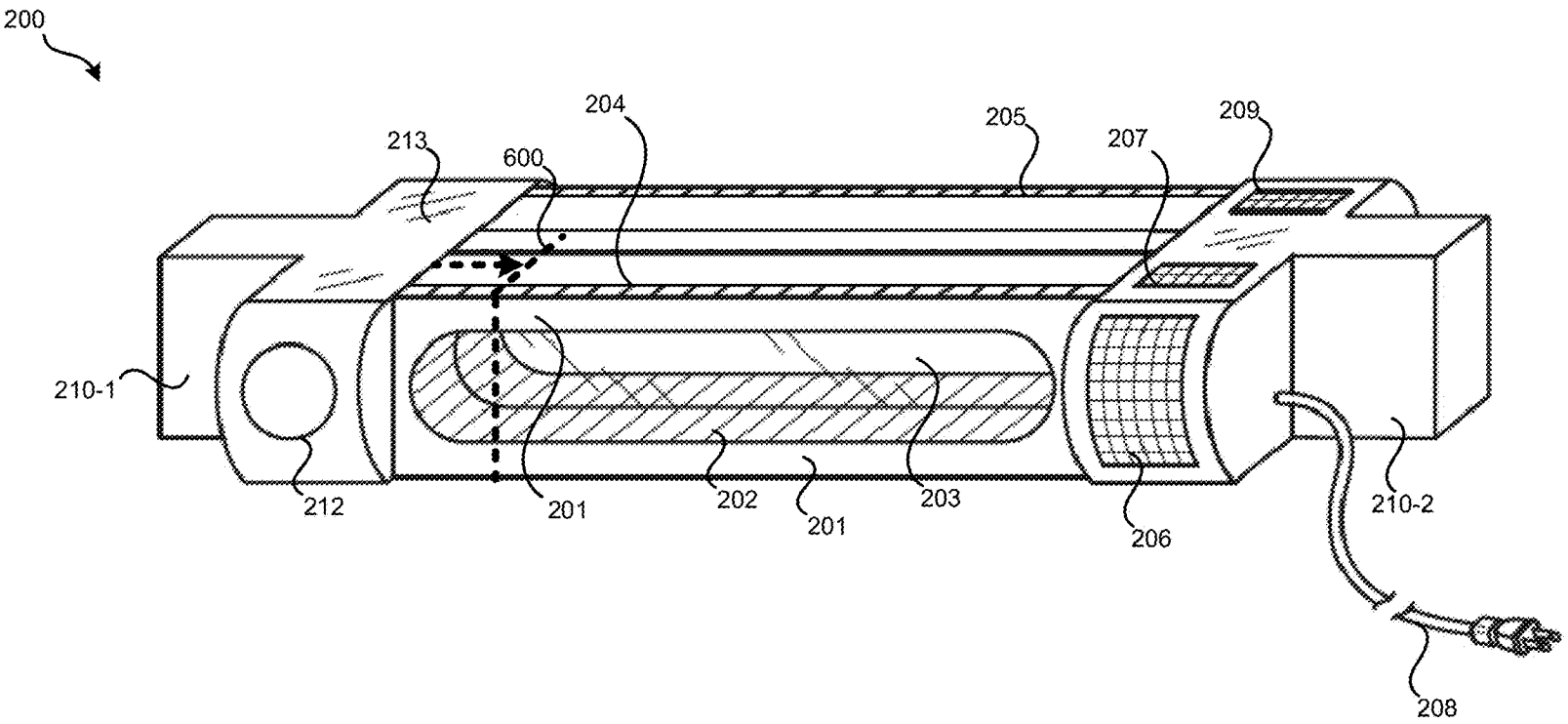
FIG. 2 illustrates an air conditioner unit having a through-unit window.

FIG. 2 illustrates an air conditioner unit 200 having a through-unit window. ACU 200 can represent an embodiment of ACU 100 of FIG. 1. ACU 200 is being viewed from an indoor side in FIG. 2. ACU 200 may include: housing face 201, ventilation gap 202, window 203, indoor air intake ports 204, outdoor air intake ports 205, front indoor bladeless fan intake vent 206, top indoor bladeless fan intake vent 207, power cord 208, top outdoor bladeless fan intake vent 209, side panel 210, side panel 211, smart thermostat control system 212, and housing 213.

Housing 213, which can include housing face 201, may house the various components of ACU 200 and may, in combination with window 203, separate indoor componentry of ACU 200 from outdoor componentry. It should be understood that ACU 200 may have an indoor side, which is intended to be installed on an interior side of a window and an outdoor side, which is intended to be installed on the exterior side of the window. Housing 213 may house componentry of smart thermostat control system 212 such that a display screen and user-interface component (which may be combined as part of a touch-screen interface) is accessible to a user via a front, indoor panel of housing 213. Smart thermostat control system 212 may include one or more temperature sensors. Such temperature sensors may be located on an exterior of housing 213, within a cavity of housing 213, and/or in or near one or more air intakes of ACU 200, such as front indoor bladeless fan intake vent 206, top indoor bladeless fan intake vent 207, indoor air intake ports 204, and/or outdoor air intake ports 205.

Housing face 201 may be a solid surface. Air may pass through top and bottom ventilation surfaces attached with housing face 201, but may not pass through housing face 201 itself. In other embodiments, housing face 201 may include at least some ventilation holes to promote the movement of air through ACU 200.

Front indoor bladeless fan intake vent 206 and top indoor bladeless fan intake vent 207 may allow air to be drawn in from an indoor environment into a concealed bladeless fan assembly (e.g., bladeless fan assembly 111-1) of ACU 200. Blades of the bladeless fan assembly may pull air from the indoor region via front indoor bladeless fan intake vent 206 and top indoor bladeless fan intake vent 207 and push air through an air ventilation chamber assembly (e.g., air ventilation chamber assembly that is arranged to permit viewing through window 203). It some embodiments, additionally or alternatively, a bottom indoor bladeless fan intake vent (not pictured) may be present. Ventilation gaps 202 may include at least two gaps from which air is expelled from a lower indoor assembly portion of ACU 200. Further detail regarding ventilation gaps 202 and associated ventilation chambers is provided in relation to FIGS. 6A-7.

On the outdoor portion of ACU 200, top outdoor bladeless fan intake vent 209 may allow air to be drawn in from an outdoor environment into a concealed bladeless fan assembly (e.g., bladeless fan assembly 111-2) of ACU 200. Blades of the outdoor bladeless fan assembly may pull air from the outdoor region via top outdoor bladeless fan intake vent 209 and push air through an outdoor air ventilation chamber assembly (e.g., an air ventilation chamber assembly that is arranged to permit viewing through window 203). It some embodiments, additionally or alternatively, a back and/or bottom outdoor bladeless fan intake vent (not pictured) may be present.

Window 203 may permit direct viewing of the outdoors through ACU 200 and/or direct viewing of the indoors from the outdoors through ACU 200. Window 203 may be at least roughly centered in ACU 200 such that when a structure's window is partially closed with ACU 200 installed, window 203 roughly aligns with the window panes of the structure's window.

Side panels 210-1 and 210-2 may fill excess space at the sides of ACU 200 when ACU 200 is installed in a window. One or both of side panels 210 may be extendable to accommodate different width windows of structures. Side panels 210 may be insulated to help decrease thermal and/or sound transfer from the outdoor side of ACU 200 to the indoor side of ACU 200. In some embodiments, window 203 may extend into side panels 210 or a separate window may be incorporated as part of one or both of side panels 210 to increase visibility of the outdoors from an indoor side of ACU 200 (and the reverse). When a structure's window is partially shut atop ACU 200, the structure's window's bottom rail may rest on top of side panels 210 and a central region of housing 213. Side panels 210 may be removable or collapsible for situations in which a window's width roughly matches with a width of ACU 200 without side panels 210. When ACU 200 is installed in a vertical configuration in a window with a horizontally-sliding slash, side panels 210 may be used to adjust a height of ACU 200 to match a height of the window.

Power cord 208 may electrically connect with a power supply housed within ACU 200 and may pass through housing 213 on an indoor side of ACU 200 to allow power cord 208 to be removably connected with an indoor power outlet. In other embodiments, power cord 208 may be a weather-proof power cable that passes through housing 213 on an exterior side of ACU 200 and connects with an outdoor power outlet. Such an arrangement may be beneficial if a user cares more for indoor aesthetics than outdoor aesthetics.

While the illustrated embodiment of ACU 200 is shown in a horizontal position, it should be understood that ACU 200 may be turned ninety degrees to accommodate a structure's window that has a horizontally-sliding sash. In some embodiments, smart thermostat control system 112 may have an integrated accelerometer, gyroscope, or other orientation-sensing sensor that allows smart thermostat control system 112 to determine whether ACU 200 is installed in a horizontal or vertical position. The operation of ACU 200 may be adjusted based on whether it is in a horizontal (as illustrated) or vertical position. For example, smart thermostat control system 112 may alter a presentation of characters and/or user interface components to be properly oriented for viewing and/or interaction by a user to accommodate both a vertical installation and a horizontal installation. In some embodiments, ACU 200 may be rotated ninety degrees either clockwise or counterclockwise from the horizontal position and smart thermostat control system 112 may sense the new orientation and adjust operation accordingly.

Figure 3A:
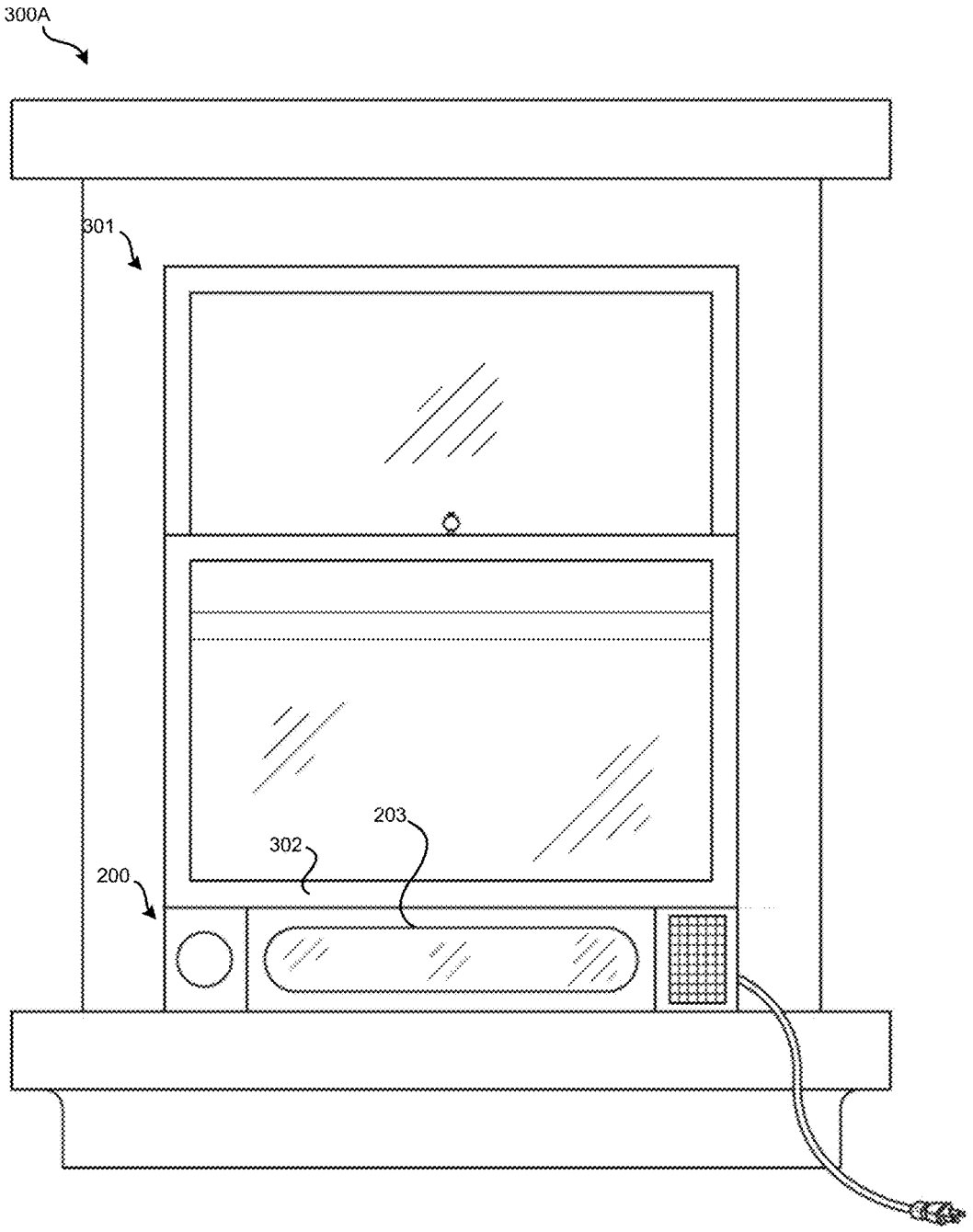
FIG. 3A illustrates an air conditioner unit installed in a window.

FIG. 3A illustrates an embodiment 300A of an air conditioner unit installed in a window, such as a home window, office window, hotel window, or window of some other type of structure. ACU 200 of FIG. 2 is installed in a vertically-actuated window 301 in FIG. 3.

Lower sash 302 of window 301 is partially raised to allow ACU 200 to be placed in window 301. Lower sash 302 is lowered to rest on a top of a housing of ACU 200, which can help stabilize ACU 200 within window 301. A user can see the outdoors through window 203 and a glass pane of lower sash 302 (and a glass pane of the upper sash). Window 203 in combination with window 301 blocks an exchange of air between outdoors and indoors. ACU 200 can be removed from window 301 by a person raising window 301 and lifting ACU 200 from its position.

Figure 3B:
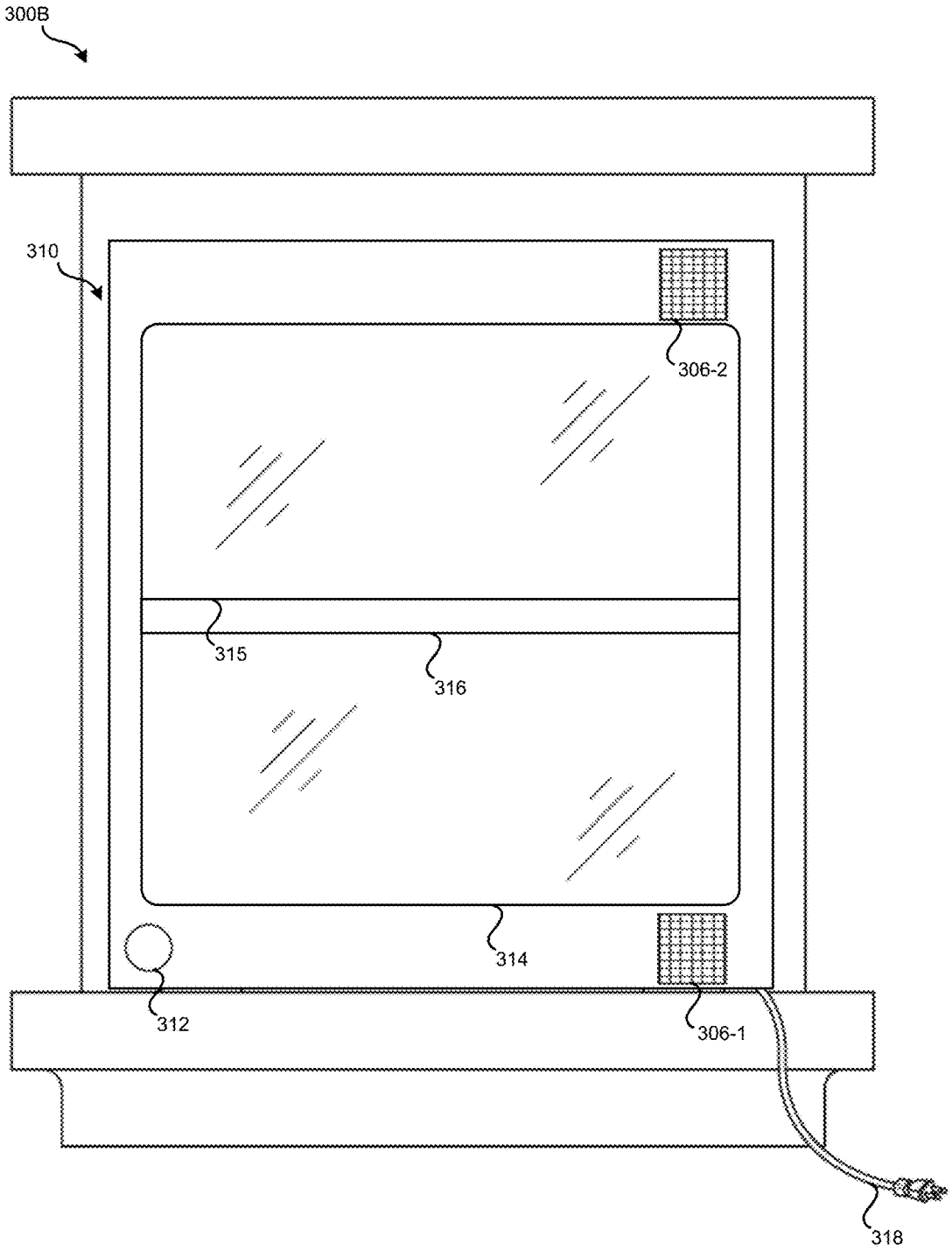
FIG. 3B illustrates an air conditioner unit incorporated as part of a window.

FIG. 3B illustrates an embodiment 300B of an air conditioner unit incorporated as part of a window. Such an assembly may be of particular use in a hotel such that each room has individual cooling (and, possibly, heating) capabilities. In embodiment 300B, componentry of ACU 100 of FIG. 1 is incorporated into a frame of window assembly 310. Window assembly 310 is permanently installed, such as using fasteners (e.g., nails, screws) or adhesive (e.g., glue) as part of a structure (e.g., home, office, building). Therefore, the ACU componentry cannot be removed easily by a person, but is rather intended to permanently remain part of the structure. The ACU componentry incorporated as part of window assembly 310 may function similarly to the detailed embodiments of ACU 100 and ACU 100. In embodiment 300B, the window portion of the ACU may be enlarged as represented by panes 314 and 315. Divider 316 between panes 314 and 315 may allow window assembly 310 to be opened to allow air to be directly exchanged between outdoors and indoors.

In embodiment 300B, two front indoor bladeless fan intake vents 306 (306-1 and 306-2) are present. Each may draw air into separate indoor bladeless fan assemblies. That is, embodiment 300B may use multiple indoor and/or outdoor bladeless fan assemblies, such as to move a greater volume of air. Air may be expelled into the indoor and outdoor environment as detailed in relation to FIGS. 2 and 5-7. In other embodiments, a single indoor bladeless fan assembly may be present.

Smart thermostat control system 312 may function as detailed in relation to smart thermostat control system 212 and may be incorporated as part of permanent window assembly 310. Power cord 318 may allow the ACU componentry to be powered from an indoor power outlet. In other embodiments, when window assembly 300B is installed, power is routed internally through the wall on which window assembly 300B is being installed such that no exposed power cords are present.

Figure 4:
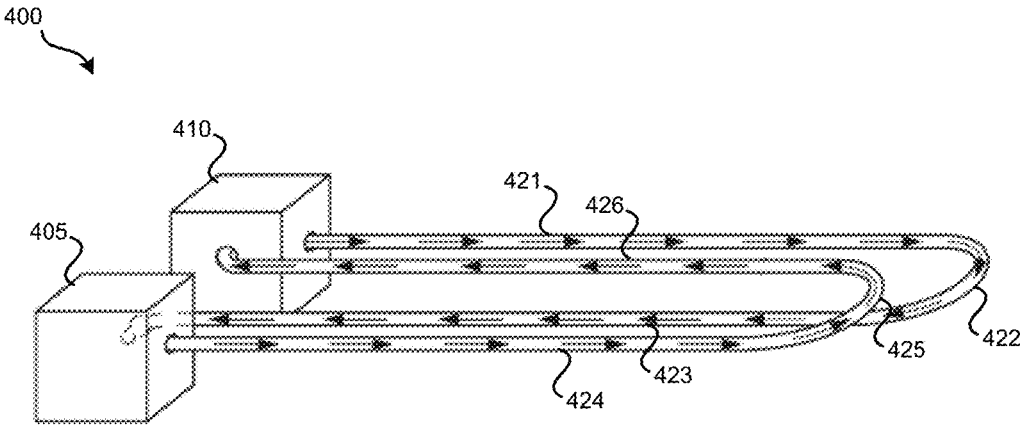
FIG. 4 illustrates an embodiment of heat pump assembly.

FIG. 4 illustrates an embodiment of heat pump assembly 400. Heat pump assembly 400 may represent a combination of indoor heat pump assembly 120 and outdoor heat pump assembly 130 of FIG. 1. Heat pump assembly 400 may be incorporated as part of ACU 200. Heat pump assembly 400 may include: expander 405, compressor 410, condensing loops 421, 422, and 423, and evaporator loops 424, 425, and 426. It should be understood that the direction of operation of heat pump assembly 400 may be reversed if heat pump assembly 400 is to function in a heating mode. That is, compressor 410 may push refrigerant in an opposite direction, and condensing loops 421-423 may function as evaporating loops and evaporating loops 424-426 may function as condensing loops.

In the illustrated embodiment of heat pump assembly 400, compressor 410, and condensing loops 421-423 are part of the outdoor componentry of the ACU. Condensing loops 421-423 may form a single loop allowing condensing loops to be positioned without interfering with a view through window 203. Referring to the embodiment of ACU 200 of FIG. 2, condensing loop 421 may be located in an outdoor portion of housing 213 in a position vertically above window 203, condensing loop 423 may be located in an outdoor portion of housing 213 in a position vertically below window 203, and condensing loop 422 may form a partial loop to reverse direction of the loop and transition the condensing loop from being vertically above window 203 to vertically below window 203. It should be understood that condensing loops 421-423 may be offset laterally from window 203 towards an outdoor side of the ACU.

Still referring to the embodiment of ACU 200 of FIG. 2, evaporator loop 424 may form a single loop and may be located in an indoor portion of housing 213 in a position vertically below window 203, evaporator loop 426 may be located in an indoor portion of housing 213 in a position vertically above window 203, and evaporator loop 425 may form a partial loop to reverse direction of the evaporator loop and transition the evaporator loop from being vertically below window 203 to vertically above window 203. It should be understood that evaporator loops 424-426 may be offset laterally from window 203 towards an indoor side of the ACU.

When operating in a cooling mode, refrigerant may be compressed by compressor 410, pass through condensing loops 421-423, release heat, then pass through expander 405 (which may simply be an expansion valve), then pass through evaporator loops 424-426, through which heat is absorbed, before the refrigerant is returned to compressor 410. Operation may be reversed if heat is to be transferred from an outdoor side of the ACU to an indoor side of the ACU.

While the embodiment of FIG. 4 illustrates a single indoor and a single outdoor loop of tubing, it should be understood that in other embodiments, a greater number of condensing and/or evaporator loops may be used. For example, referring to FIG. 6A, three connected evaporator loops are used. Other embodiments may have greater or fewer numbers of loops.

Figure 5:
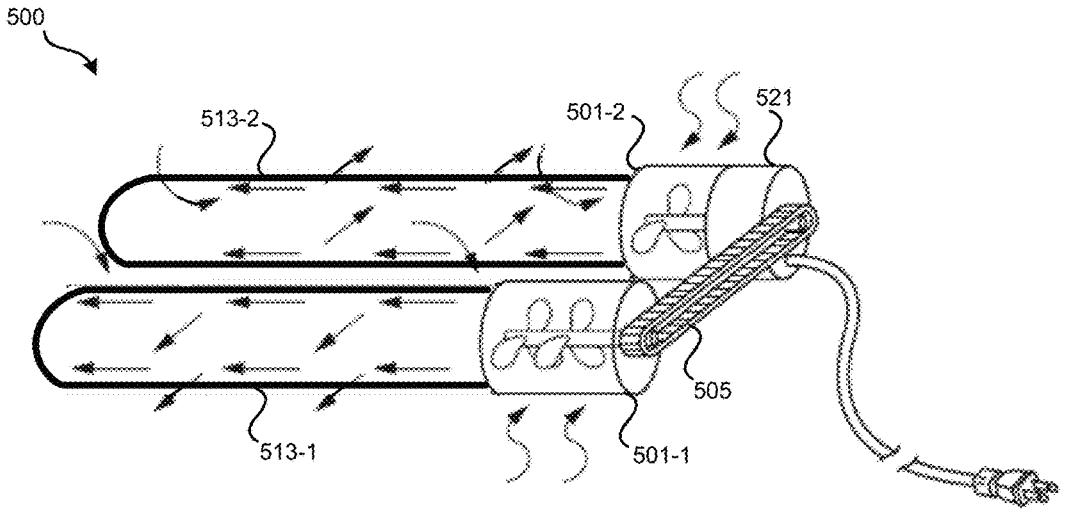
FIG. 5 illustrates an embodiment of air flow around the heat pump assembly.

FIG. 5 illustrates an embodiment 500 of air flow around the heat pump assembly. Embodiment 500 illustrates how air may flow around the heat pump assembly of FIG. 4. The components of embodiment 500 may be part of ACU 100 and/or ACU 200. In embodiment 500, indoor bladeless fan assembly 501-1 and outdoor bladeless fan assembly 501-2 drive air through indoor ventilation chamber assembly 513-1 and outdoor ventilation chamber assembly 513-2, respectively. Indoor bladeless fan assembly 501-1 may correspond to indoor bladeless fan assembly 111-1, outdoor bladeless fan assembly 501-2 may correspond to outdoor bladeless fan assembly 111-2, indoor ventilation chamber assembly 513-1 can correspond to air ventilation chamber assembly 113-1 and outdoor ventilation chamber assembly 513-2 may correspond to air ventilation chamber assembly 113-2. Bladeless fan assembly 50-1 may be driven by drive chain 505, which can also be in the form of a belt or gears. Bladeless fan drive motor 521, which can correspond to bladeless fan drive motor 123, may be located as part of the outdoor componentry of an ACU and may drive indoor bladeless fan assembly 501-1 via the drive chain. Bladeless fan drive motor 521 may also drive outdoor bladeless fan assembly 501-2, either directly (as illustrated) or via the same or different drive chain, belt, or gears. Bladeless fan drive motor 521 may be selectively engaged such that a single bladeless fan assembly can be driven at a time in addition to the blades of both bladeless fan assemblies being driven.

Indoor bladeless fan assembly 501-1 may use blades to drive indoor air through indoor ventilation chamber assembly 513-1. Outdoor bladeless fan assembly 501-2 may use blades to drive outdoor air through outdoor ventilation chamber assembly 513-2. Bladeless fan assemblies 501 may distribute the driven air and use inducement and/or entrainment to increase the amount of air being driven through the indoor or outdoor environment. Further detail regarding bladeless fan assemblies 501 is provided in relation to FIGS. 6 and 7.

Figure 6A:
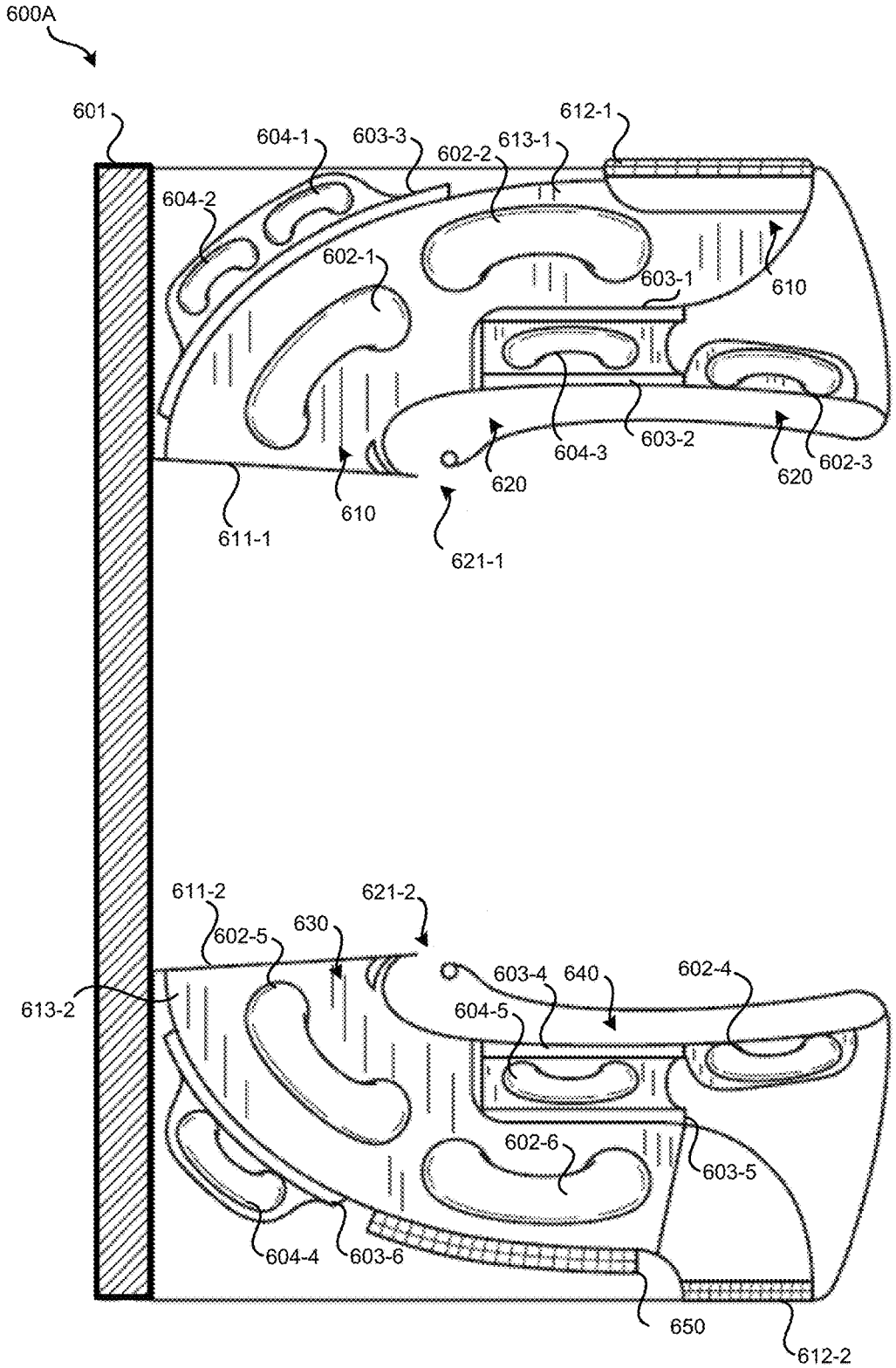
FIG. 6A illustrates a cross-section of an embodiment of an air ventilation chamber assembly.

FIG. 6A illustrates a cross-section 600A of an embodiment of an indoor air ventilation chamber assembly. Cross-section 600A is indicated on FIG. 2. Cross-section 600A represents a cross section of the indoor componentry portion of ACU 200 at the indicated location on FIG. 2. It should be understood that the outdoor air ventilation chamber assembly may be similarly arranged, but in a mirrored configuration in an outdoor portion of an ACU. Cross-section 600A can be understood as illustrating a cross section of air ventilation chamber assembly 113-1 of ACU 100. Such an air ventilation chamber assembly may be used as part of any of the previously detailed embodiments of ACUs.

Cross-section 600A illustrates window 601, indoor componentry of an ACU, and four distinct ventilation chambers: ventilation chamber 610, ventilation chamber 620, ventilation chamber 630, and ventilation chamber 640. Ventilation chambers 620 and 640 may have air driven through them by in bladeless fan assembly, such as bladeless fan assembly 111-1 of ACU 100. In cross-section 600A air passes through ventilation chambers 620 and 640 in a direction normal to cross-section 600A. Air driven by the bladeless fan assembly that pushes air into ventilation chambers 620 and 640 may exit through ventilation gaps 621-1 and 621-2.

Air that is driven through ventilation chambers 620 and 640 may be cooled using one or more cooling systems. Peltier cooler 603-2 (which can also be referred to as a thermoelectric cooler) may have a hot side and a cold side induced by direct current electricity being passed through a series of interconnected n-type and p-type semiconductors. The cold side of Peltier cooler 603-2 may be thermodynamically coupled with an exterior surface of ventilation chamber 620. The hot side of Peltier cooler 603-2 may be thermodynamically coupled with a heat pipe 604-3 such that the hot side of Peltier cooler 603-2 may be maintained approximately at the ambient temperature. Peltier cooler 603-2 may cool air driven through ventilation chamber 620. Similarly, the cold side of Peltier cooler 603-4 may be thermodynamically coupled with an exterior surface of ventilation chamber 640. The hot side of Peltier cooler 603-4 may be thermodynamically coupled with a heat pipe 604-5 such that the hot side of Peltier cooler 603-4 may be maintained approximately at the ambient temperature.

It should be understood that "thermodynamically coupled" refers to components being in direct physical contact or connected by another component, such as a thermodynamically conductive paste, that helps accelerate heat transfer.

Air that is driven through ventilation chamber 620 and 640 may, additionally or alternatively, be cooled using evaporator loops 602-3 and 602-4. Such loops may be made of metallic tubing or otherwise thermodynamically conductive tubing. While in some previous embodiments it was detailed that a single loop of an evaporator loop and a single loop of a compressor loop may be present, in other embodiments, multiple loops of evaporator loops and/or compressor loops may be present. For example, in illustrated cross-section 600A, six evaporator loops 602 are illustrated. It should be understood that in the location of ACU 200 at which cross-section 600A is illustrated, each evaporator loop loops to reverse the direction in which refrigerant flows. If a cross section was taken in a more central location of ACU 200, each evaporator loop of evaporator loops 602 could appear to be distinct pairs of tubes.

Evaporator loops 602-3 and 602-4 may be thermodynamically coupled with an exterior of ventilation chambers 620 and 640, respectively. Depending on an operating state of the ACU, Peltier coolers 603-2 and 603-4 may be powered while refrigerant is being pumped through evaporator loops 602-3 and 602-4. Alternatively, only Peltier coolers 603-2 and 603-4 may be activated or only the heat pump system that uses evaporator loops 602-3 and 602-4 may be activated.

Air driven by a bladeless fan assembly that exits through ventilation gaps 621-1 and 621-2 may cause air to be induced and/or entrained to flow through their ventilation chambers 610 and 630, respectively. Ventilation chambers 610 and 630 may be subdivided by various metallic fins, such as metallic fins 613-1 and 613-2, which are normal to evaporator loops 602-1, 602-2, 602-5, and 602-6. Therefore, by air being driven through ventilation chamber 620 and exiting through ventilation gap 621-1, air is induced and/or entrained to be taken into ventilation chamber 620 through air intake 612-1, pass around evaporator loops 602-1 and 602-2, and exit through ventilation gap 611-1. Similarly, on the lower portion of the assembly, by air being driven through ventilation chamber 640 and exiting through ventilation gap 621-2, air is induced and/or entrained from the indoor environment to be taken into ventilation chamber 630 through air intake 612-2, pass around evaporator loops 602-6 and 602-5, and exit through ventilation gap 611-2. Air passing around evaporator loops 602-1, 602-2, 602-5, and 602-6 may be cooled when such evaporator loops are lower than a temperature of the air.

Peltier coolers may also be used to cool air present in ventilation chamber 610 and/or 630. Peltier cooler 603-1 may be thermodynamically coupled with a surface of ventilation chamber 610. The portion of Peltier cooler 603-1 coupled with ventilation chamber 610 may be the cool side of Peltier cooler 603-1, while a hot side of Peltier cooler 603-1 is thermodynamically coupled with heat pipe 604-3. Similarly, on the lower portion of the assembly, Peltier cooler 603-5 may have its cool side thermodynamically coupled with an exterior surface of ventilation chamber 630 and have its hot side thermodynamically coupled with heat pipe 604-5.

One or more additional Peltier coolers may also be present to cool air within ventilation chambers 610 and 630. In the upper portion of the assembly, Peltier cooler 603-3 has its cool side thermodynamically coupled with an exterior surface of ventilation chamber 610. The hot side of Peltier cooler 603-3 is thermodynamically coupled with two heat pipes: heat pipe 604-1 and heat pipe 604-2. The lower half of the assembly, Peltier cooler 603-6, has its cool side thermodynamically coupled with an exterior surface of ventilation chamber 630. The hot side of Peltier cooler 603-6 is coupled with heat pipe 604-4.

Heat pipes 604 may be thermodynamically conductive materials that help transfer heat from the hot side of Peltier coolers to another environment, such as in outdoor portion of the ACU. It should be understood that the functionality of Peltier coolers 603 may be reversed if the ACU is to function as a heater rather than an air conditioner for an indoor environment. Heat pipes 604 may be either active or passive. An active heat pipe may have a liquid or gas that is pumped within the heat pipe that helps expedite transfer of thermodynamic energy from a coupled side of a Peltier cooler 603 to another location. A passive heat pipe may be either solid or contain a liquid or gas that is not pumped that helps expedite transfer of thermodynamic energy from the coupled side of a Peltier cooler 603 to another location.

When cold, evaporator loops 602 may tend to cause water to condensate from the air onto the surfaces of evaporator loop 602. If sufficient water condensates, such water may drip from the condenser loops of the upper portion of the assembly into the lower portion of the assembly and from evaporator loops 602-5 and 602-6 into condensation catch 650. Condensation catch 650 may capture water such that the water does not drop or seep out of air intake 612-2. Condensation catch 650 may be coupled with a tube and drain that directs such condensed water to an exterior environment, such as where it may be allowed to drip outdoors.

Figure 6B:
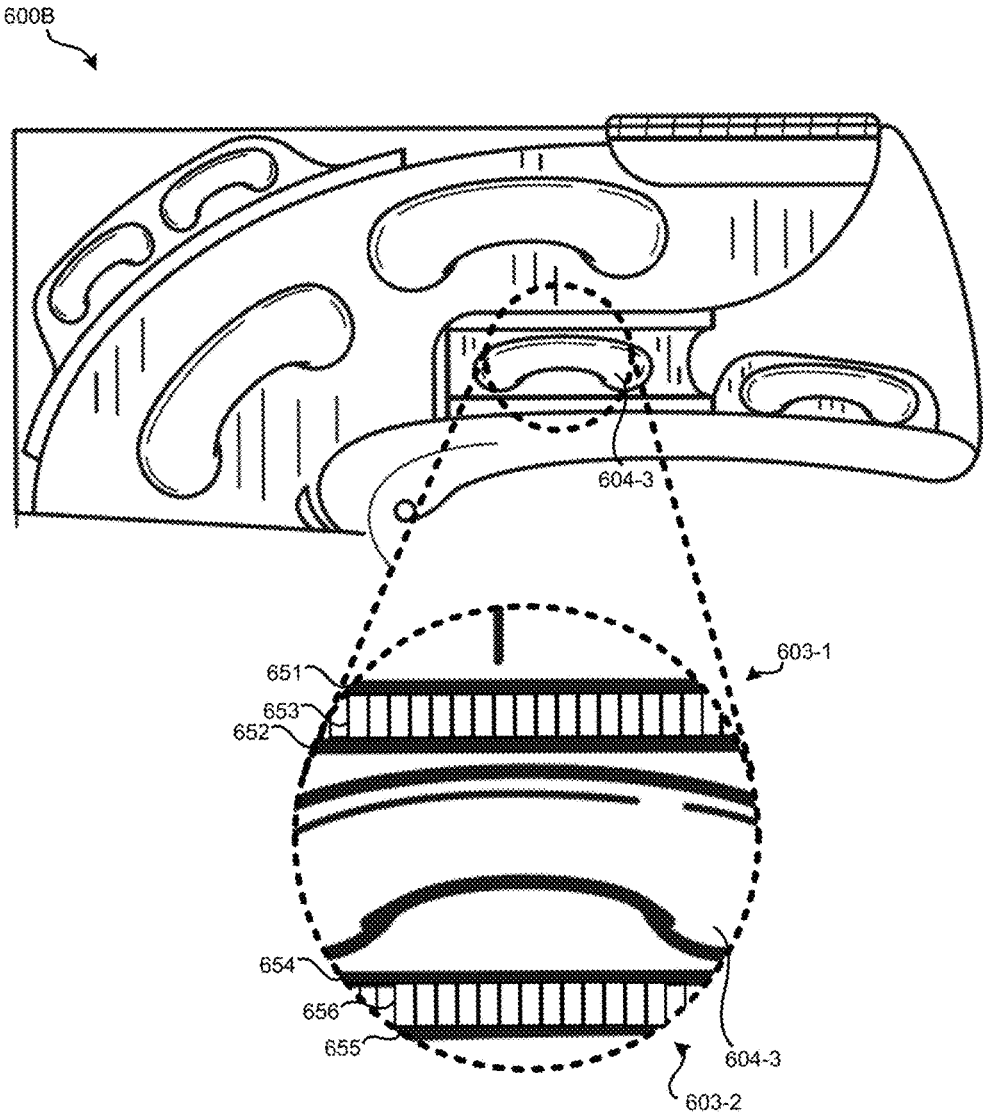
FIG. 6B illustrates a magnified portion of the cross-section of FIG. 6A.

FIG. 6B illustrates an embodiment 600B in a magnified view of the cross-section of FIG. 6A. In embodiment 600B, additional detail of Peltier coolers 603-1 and 603-2 can be seen.

For Peltier cooler 603-1, hot side 651, cold side 652, and semiconductor junctions 653 can be seen. For Peltier cooler 603-2, hot side 654, cold side 655, and semiconductor junctions 656 can be seen. Interconnects are also present to interconnect the n-type and p-type semiconductors. It may be possible to reverse an applied voltage and current in order to reverse the cooling effect of the Peltier coolers, such as Peltier coolers 603-1 and 603-2, thus reversing which sides of each Peltier cooler is hot and cold.

Figure 6C:
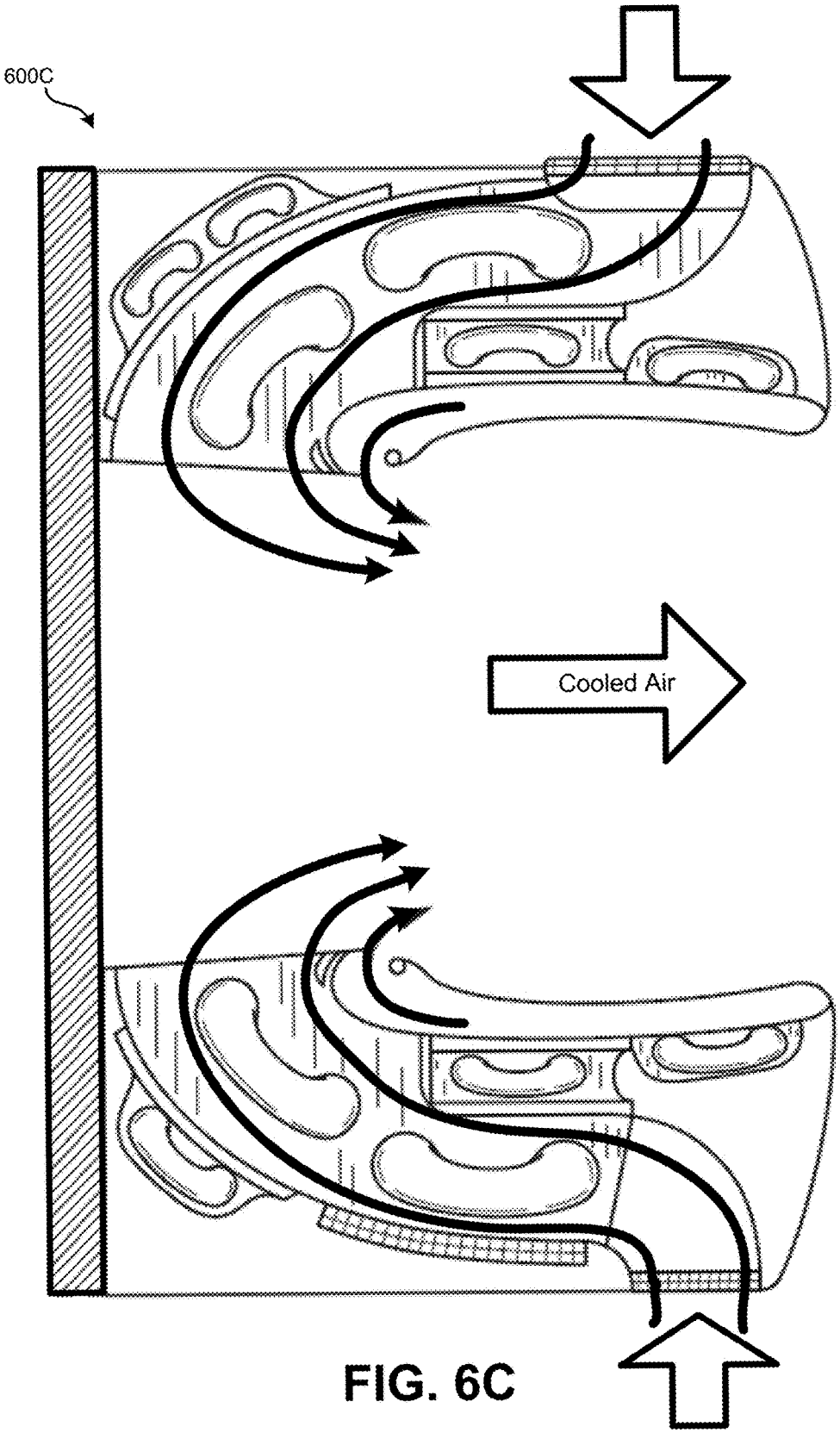
FIG. 6C illustrates airflow through the cross-section of an embodiment of an air ventilation chamber assembly.

FIG. 6C illustrates an embodiment 600C of airflow through a cross-section of an embodiment of an air ventilation chamber assembly. Airflow driven by blades through ventilation chambers 620 and 640 exiting through ventilation gaps 621 induces and/or entrains air to flow through ventilation chambers 610 and 630. The cooled (or heated) air then moves back into the indoor environment.

Figure 6D:
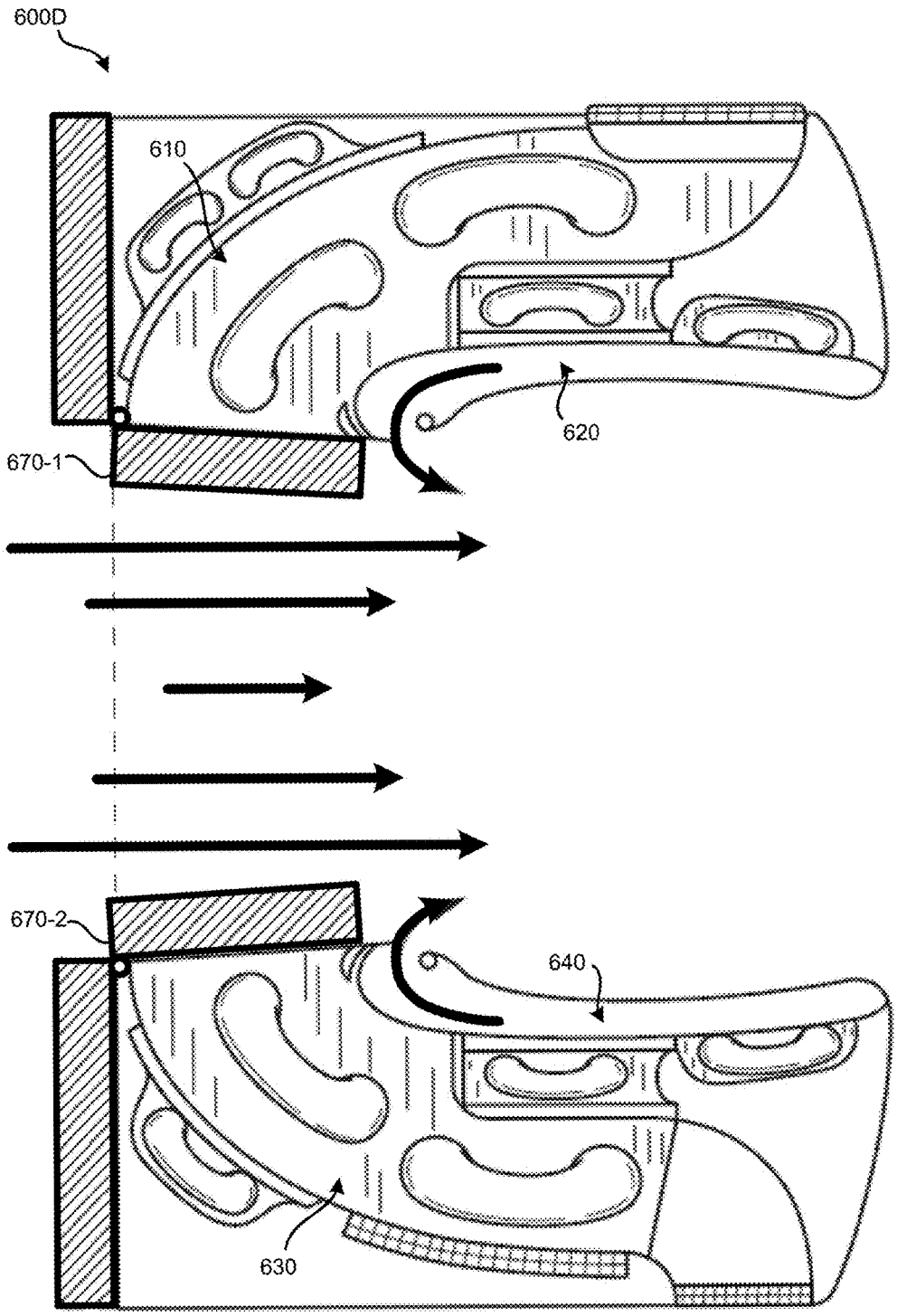
FIG. 6D illustrates airflow through a cross-section of an embodiment of an air ventilation chamber assembly with a split-window design.

FIG. 6D illustrates an embodiment 600D of airflow through a cross-section of an embodiment of an air ventilation chamber assembly with a split-window design. In embodiment 600D, the window can be opened such that open window portion 670-1 blocks air ventilation chamber 610. As such, air driven through ventilation chamber 620 induces and/or entrains airflow from outdoors rather than air ventilation chamber 610. Similarly, air driven through ventilation chamber 640 induces and/or entrains airflow from outdoors rather than air ventilation chamber 630 due to open window portion 670-2 being in the open position. Such an arrangement with the indoor bladeless fan assembly active and the outdoor air assembly inactive may be used when the indoor bladeless fan assembly is being used to drive outdoor (e.g., fresh) air indoors. A linear passageway from the outdoors to the indoors may be present and allow air to be induced and/or entrained to the indoors. In such an arrangement, the cooling systems of the ACU may be disabled. The reverse arrangement, where the outdoor bladeless fan is active with the indoor bladeless fan assembly disabled to drive indoor air outside may also be possible.

Figure 7A:
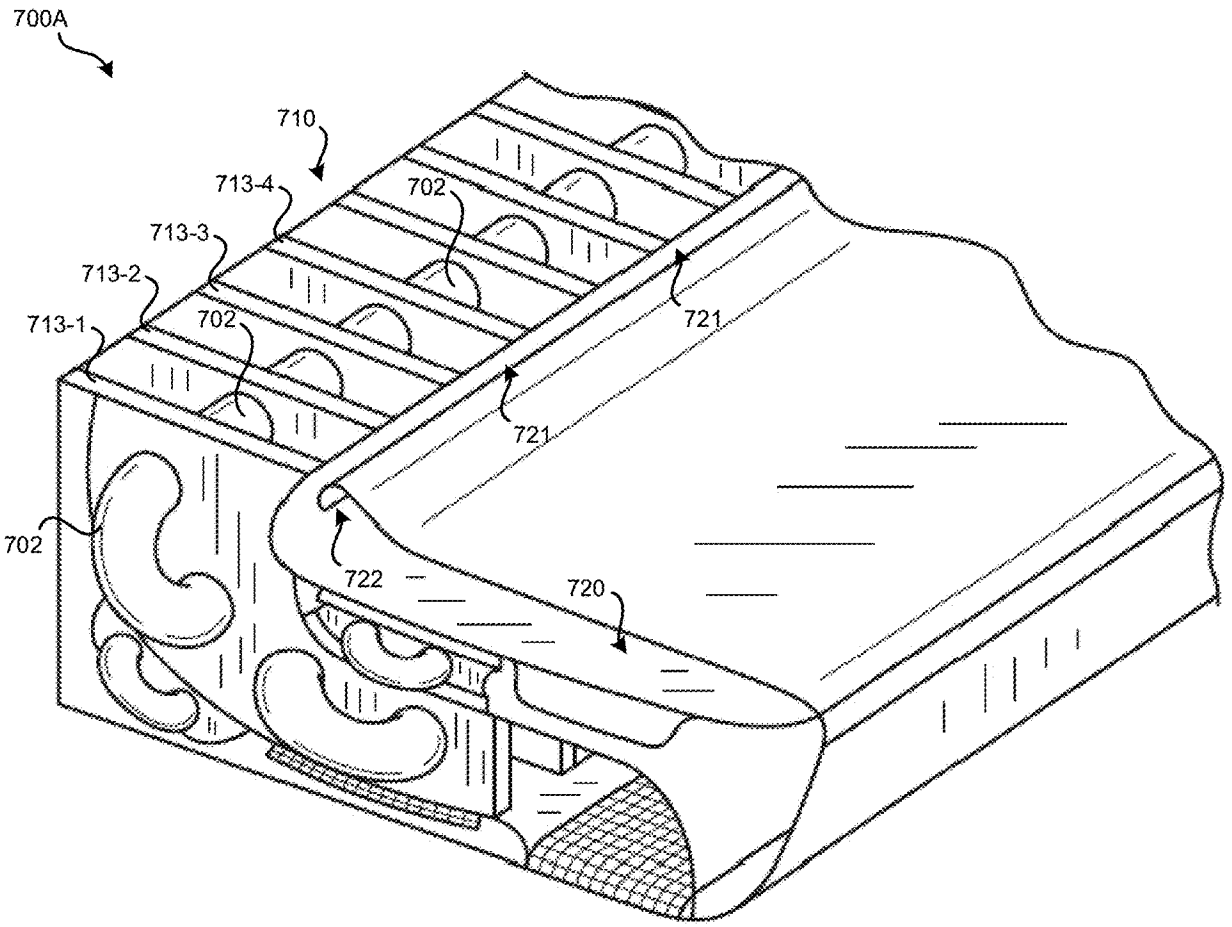
FIG. 7A illustrates an angled view of an embodiment of an air ventilation chamber assembly.

FIG. 7A illustrates an angled view 700A of an embodiment of a lower air ventilation chamber assembly. Angled view 700 shows a three-dimensional view of a lower portion of cross section 600 of FIG. 2. Fins 713 (e.g., fins 713-1, 713-2, 713-3, and 713-4) may divide ventilation chamber 710. Air may enter through an air intake, such as air intake 612-2 of FIG. 6A, pass through a divided portion of ventilation chamber 710, and exit via a ventilation gap due to inducement and/or entrainment of air exiting ventilation gap 721 of ventilation chamber 720. Evaporator loop 702, along with other evaporator loops, may pass through and be thermodynamically coupled with fins 713. Fins 713 may be thermodynamically conductive, such as made from aluminum or some other metal. Fins 713 may be cooled by evaporator loop 702 such that cooled fins 713 increase an amount of cooled surface air which air passing through ventilation chamber 710 is exposed to, thus helping to cool the air.

Figure 7B:
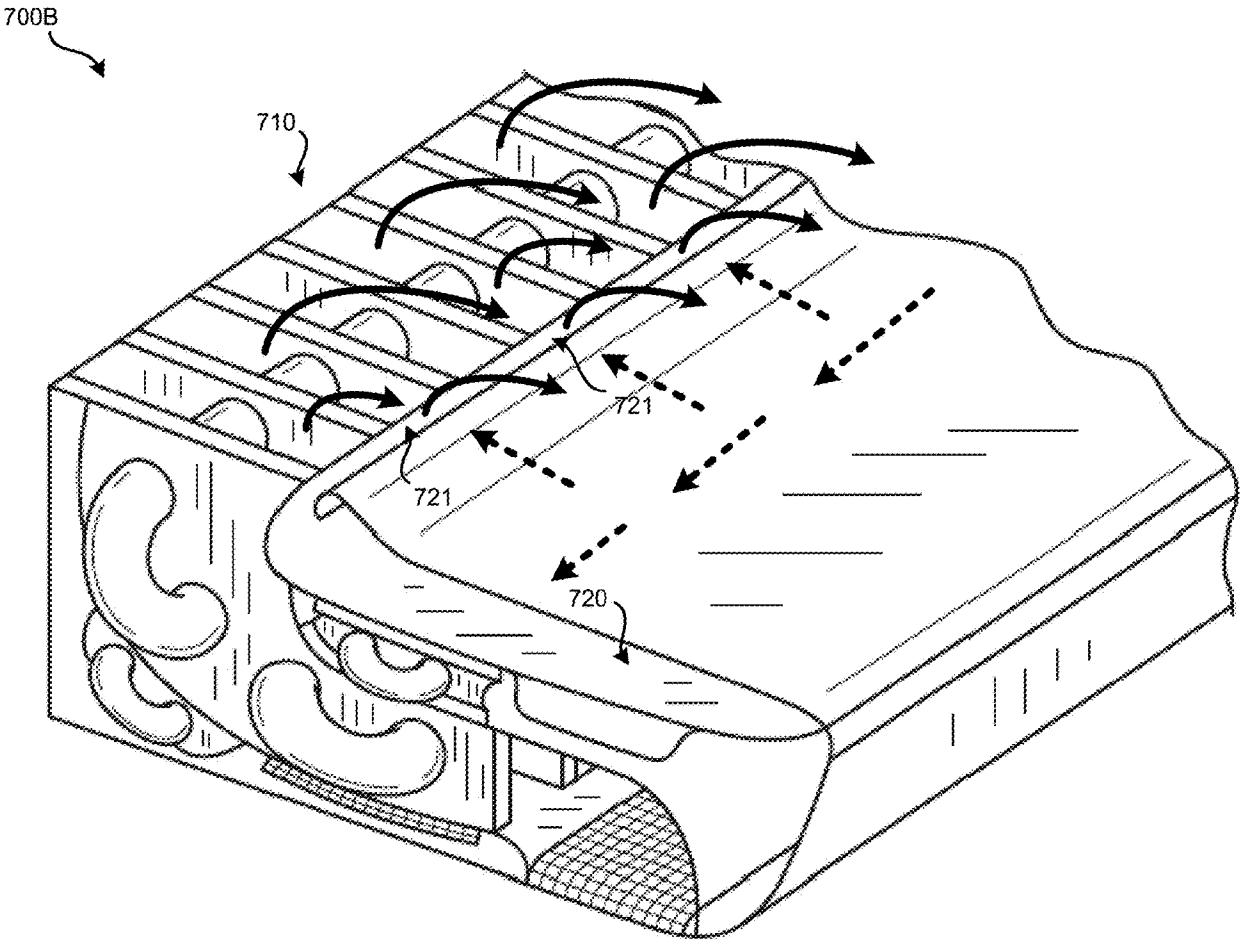
FIG. 7B illustrates an angled view of an embodiment of the airflow through an air ventilation chamber assembly.

FIG. 7B illustrates an angled view 700B of the embodiment of FIG. 7A illustrating airflow. Air may be driven through ventilation chamber 720 (as illustrated by the dotted arrows) and exit through ventilation gap 721 (as illustrated by the solid arrows). Air exiting through ventilation gap 721 may induce and/or entrain air from the various divided portions of ventilation chamber 710.

Figure 8:
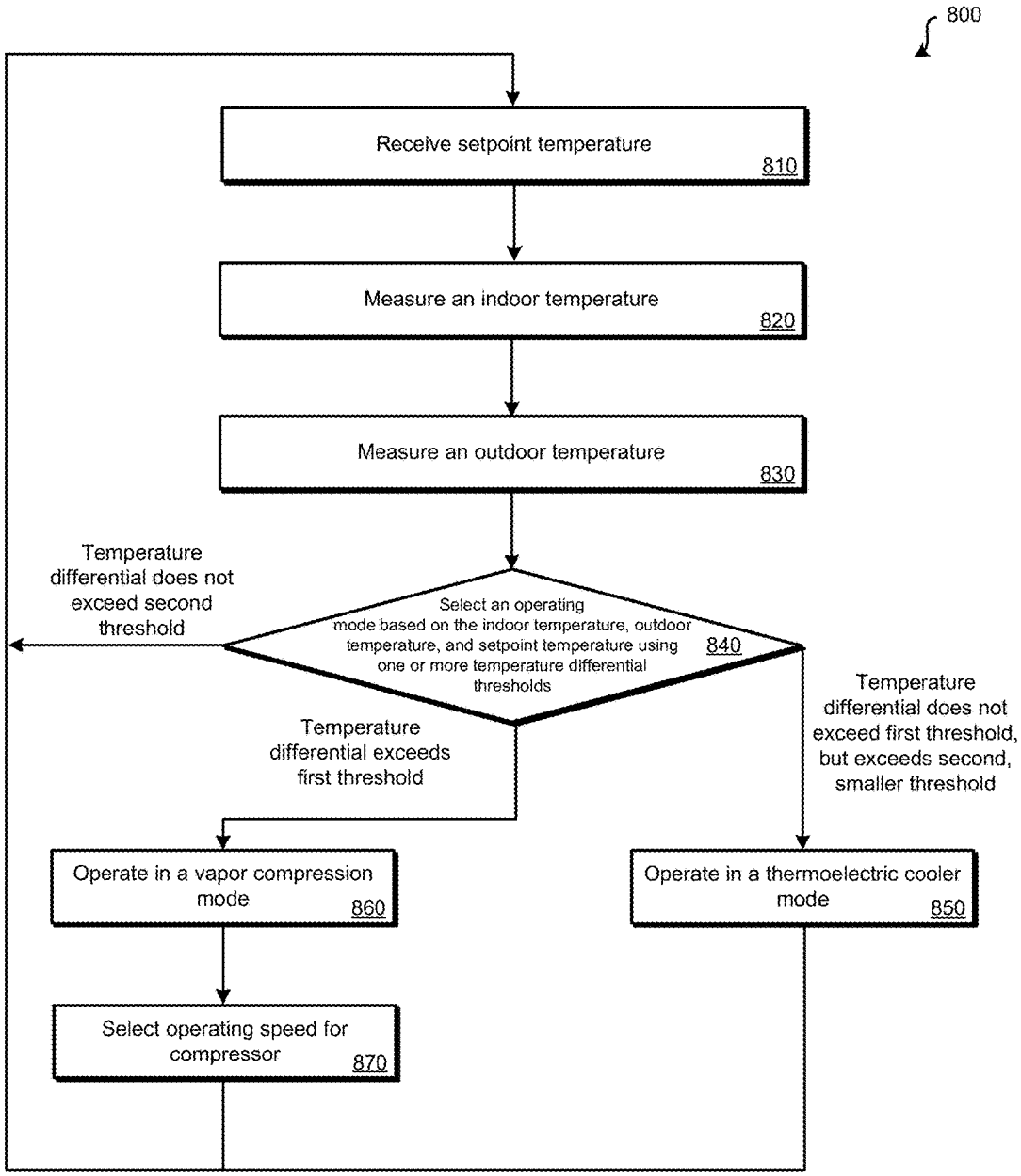
FIG. 8 illustrates an embodiment of a method for operating an air conditioner unit in a vapor compression mode and a thermoelectric cooler mode.

FIG. 8 illustrates an embodiment of a method 800 for operating an air conditioner unit in a vapor compression mode and a thermoelectric cooler mode. Blocks of method 800 may be performed using the previously-detailed embodiments of ACUs and ACU components.

At block 810, a setpoint temperature may be received. The setpoint temperature may define a desired temperature to which a user desires the room to be cooled or warmed. In some embodiments, the setpoint temperature may be input directly to the ACU by a user, such as via a smart thermostat control system of the ACU. In some embodiments, a native application executed by a mobile device or a web-based interface may be used by a user to provide a setpoint temperature to a remote server. The smart thermostat control system of the ACU may periodically query the remote server and, when such a new or updated setpoint is available, retrieve the setpoint for storage and enforcement by the ACU. In some embodiments, a separate thermostat unit may wirelessly transmit setpoint information to the ACU. In still other embodiments, the separate thermostat unit may wirelessly instruct the ACU when to turn on and off without providing the ACU with a specific setpoint (that is, the setpoint may be enforced by the separate thermostat unit via wireless commands transmitted to the ACU).

At block 820, an indoor temperature may be measured by the ACU using one or more temperature sensors. In some embodiments, one or more temperature sensors are located in or near air intakes on an indoor side of the ACU. In some embodiments, one or more remote temperature sensors may be used to measure the indoor temperature. For example, a remote thermostat that can control one or more heating, ventilation, and/or cooling systems may wirelessly provide temperature data to the ACU or a dedicated remote temperature sensing unit, such as a unit that plugs into an outlet within the room being cooled, may wirelessly provide temperature data to the ACU. The ACU may measure outdoor temperature at block 830. One or more temperature sensors may be located on an outdoor portion of the ACU, such as in or near an outdoor air intake, such as top outdoor bladeless fan intake vent 209 of FIG. 2. In some embodiments, weather data may be retrieved by the ACU from an external source, such as an Internet-based service that provides temperature data on a regional basis (e.g., per zip code). Alternatively, one or more separate outdoor sensors may provide outdoor temperature data to the ACU. Additionally, at block 830, a decision may be made by the ACU as to whether the ACU should operate in a heating or cooling mode.

At block 840, an operating mode may be selected by the smart thermostat control system of the ACU based on the indoor temperature, outdoor temperature, and setpoint temperature. The operating mode selected at block 840 may be based on the temperature differential between the indoor temperature and the setpoint temperature. The outdoor temperature may be additionally used to evaluate which operating mode should be activated. If a temperature difference greater than a first threshold is present, a vapor compression mode may be used. But if the temperature difference is smaller than the first threshold, but larger than a second, smaller threshold, a thermoelectric cooler may be engaged instead. Regardless of mode, air may be driven through the air ventilation chamber assemblies of the ACU in a similar manner. In some embodiments, the speed at which the blades of the bladeless fan assemblies may be varied, either based on the temperature differentials or based on a user setting (e.g., fan speed). The operating mode selected can be based on which mode will cool the interior environment in the most energy efficient way.

At block 850, if the temperature difference is smaller than the first threshold, but larger than a second, smaller threshold, the ACU may be operated in a thermos-electric cooler only mode. In this mode, all or some of the Peltier coolers of the ACU may be powered and provide cooling, but the vapor compression system of the ACU, including the compressor and expander, may be disengaged or otherwise not powered. This mode may be more energy efficient when a small temperature differential is present.

At block 860, if a temperature difference greater than the first threshold is present, the vapor compression mode may be used. Vapor compression mode involves the compressor being activated to pump and compress refrigerant to either heat or cool the interior environment using the evaporator loops and condensing loops. This mode may be more energy efficient when a large temperature differential is present. In this mode, some or all of the Peltier coolers may be disengaged or otherwise not powered. At block 870, an operating speed for the compressor of the heat pump system may be selected. The operating speed may be increased for large temperature differentials and decreased for smaller temperature differentials.

While two modes of operation are illustrated in method 800, it should be understood that various additional modes may be present. For example, one or more transition modes may be present in which one or more thermoelectric coolers are engaged prior to the compressor being completely disengaged from operating at a low speed. In another example of an additional mode, for maximum cooling, all Peltier coolers and the heat pump system may be engaged simultaneously.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the embodiments detailed herein. Also, a number of steps may be undertaken before, during, or after the above elements are considered.

What is claimed is:

1. An air conditioner system comprising:

an air ventilation chamber assembly comprising:

a first chamber and a second chamber through which air is circulated into an environment to be cooled;

a cooling element passing through the first chamber of the air ventilation chamber assembly, wherein the cooling element does not pass through the second chamber of the air ventilation chamber assembly; and a Peltier cooler having a cold side and a hot side, wherein the cold side is thermodynamically coupled with a surface of the second chamber.

2. The air conditioner system of claim 1, further comprising a bladed air driver that induces and/or entrains airflow through the first chamber of the air ventilation chamber assembly by moving air through the second chamber of the air ventilation chamber assembly.

3. The air conditioner system of claim 1, further comprising a Peltier cooler assembly, wherein:

the Peltier cooler assembly includes: the Peltier cooler, a second Peltier cooler, and a heat pipe;

the second Peltier cooler having a second cold side and a second hot side, wherein the second cold side is thermodynamically coupled with a surface of the first chamber; and the hot side of the Peltier cooler and the second hot side of the second Peltier cooler are thermodynamically coupled with the heat pipe.

4. The air conditioner system of claim 1, further comprising: a plurality of fins arranged in the first chamber of the air ventilation chamber assembly such that each of the plurality of fins is perpendicular to the cooling element.

5. The air conditioner system of claim 1, further comprising: a condensation collection assembly located along an inner surface of the first chamber of the air ventilation chamber assembly.

6. The air conditioner system of claim 1, further comprising:

a second air ventilation chamber assembly comprising:

a third chamber and a fourth chamber through which air is circulated into the environment to be cooled, wherein the cooling element passes through the third chamber of the second air ventilation chamber assembly but not the fourth chamber of the air ventilation chamber assembly; and a second Peltier cooler having a second cold side and a second hot side, wherein the cold side is thermodynamically coupled with a surface of the fourth chamber.

7. The air conditioner system of claim 6, further comprising a through-unit window, the through-unit window permitting an unobstructed view through the air conditioner system between the air ventilation chamber assembly and the second air ventilation chamber assembly.

8. The air conditioner system of claim 7, wherein the through-unit window is removable to permit air to pass from an exterior environment into an interior environment between the air ventilation chamber assembly and the second air ventilation chamber assembly.

9. The air conditioner system of claim 8, further comprising a bladed air driver that induces and/or entrains airflow from the exterior environment to the interior environment between the air ventilation chamber assembly and the second air ventilation chamber assembly by moving air through the second chamber and the fourth chamber.

10. The air conditioner system of claim 1, wherein a portion of cooling element is thermodynamically coupled with a surface of the second chamber of the air ventilation chamber assembly such that a second portion of the cooling element is located outside of the second chamber.

11. The air conditioner system of claim 1, further comprising an evaporator and compressor that circulate refrigerant through evaporator tubing.

12. The air conditioner system of claim 11, wherein operation of the air conditioner system is operable to provide heating to the environment by reversing a voltage applied to the Peltier cooler and operating a heat pump, which comprises the evaporator tubing, in reverse.

13. The air conditioner system of claim 11, further comprising a thermostat control system that controls the Peltier cooler independently of a compressor that pumps refrigerant through the evaporator tubing.

14. An air conditioner apparatus comprising:

a ventilation chamber means comprising:

a first chamber and a second chamber through which air is circulated into an environment to be cooled;

a heat pump means having an element passing through the first chamber of the ventilation chamber means, wherein the element does not pass through the second chamber of the ventilation chamber means;

a thermoelectric cooling means having a cold side and a hot side, wherein the cold side is thermodynamically coupled with the second chamber; and an electronic control means that independently controls the thermoelectric cooling means and the heat pump means.

15. The air conditioner apparatus of claim 14, further comprising an air driving means that causes airflow through the first chamber of the ventilation chamber means and through the second chamber of the ventilation chamber means.

16. The air conditioner apparatus of claim 14, further comprising a plurality of heat sink means arranged in the first chamber of the ventilation chamber means.

17. The air conditioner apparatus of claim 14, further comprising: a condensation collection means located along an inner surface of the first chamber of the ventilation chamber means.

18. The air conditioner apparatus of claim 14, further comprising a through-unit viewing means, the through-unit viewing means permitting an unobstructed view through the air conditioner apparatus between the ventilation chamber means and a second ventilation chamber means.

19. The air conditioner apparatus of claim 14, further comprising a wireless communication means that receives temperature measurements from a remote temperature sensor unit.

* * * * *